US009759066B2

(12) United States Patent
Schevets

(10) Patent No.: US 9,759,066 B2
(45) Date of Patent: Sep. 12, 2017

(54) UNITARY PUMP AND TURBINE ENERGY EXCHANGER

(71) Applicant: Amorphic Tech Ltd., Bethlehem, PA (US)

(72) Inventor: Andrew Schevets, Bethlehem, PA (US)

(73) Assignee: Amorphic Tech Ltd, Bethlehem, PA (US)

( * ) Notice: Subject to any disclaimer, the term of this patent is extended or adjusted under 35 U.S.C. 154(b) by 193 days.

(21) Appl. No.: 14/690,737

(22) Filed: Apr. 20, 2015

(65) Prior Publication Data

US 2015/0300174 A1 Oct. 22, 2015

Related U.S. Application Data

(60) Provisional application No. 61/981,880, filed on Apr. 21, 2014.

(51) Int. Cl.
*F01C 11/00* (2006.01)
*F03C 2/00* (2006.01)
(Continued)

(52) U.S. Cl.
CPC ..... *F01C 21/18* (2013.01); *F01C 1/3446* (2013.01); *F01C 11/004* (2013.01);
(Continued)

(58) Field of Classification Search
CPC ..... F01C 21/18; F01C 1/3446; F01C 11/004; F01C 21/106; F04C 23/008; F04C 15/06; F04C 15/062; F04C 29/122; F04C 2/3446
(Continued)

(56) References Cited

U.S. PATENT DOCUMENTS 3,160,147 A * 12/1964 Hanson ..... F04C 2/3446 418/266
3,686,893 A * 8/1972 Edwards ..... F01C 21/06 418/86

(Continued)

FOREIGN PATENT DOCUMENTS

| | | |
|---|---|---|
| EP | 2224095 | 1/2010 |
| WO | 2009/073406 | 6/2009 |

OTHER PUBLICATIONS

International Search Report and Written Opinion for corresponding PCT Application No. PCT/US2015/026666, dated Jul. 23, 2015.

*Primary Examiner* — Theresa Trieu
(74) *Attorney, Agent, or Firm* — Gardner, Linn, Burkhart & Flory, LLP

(57) ABSTRACT

A positive-displacement unitary pump and turbine is operable as a fluid energy exchanger using a charging fluid as motive force and acting upon a separate feed fluid that exits the turbine at an elevated energy state. The rotor casing defines a rotor chamber having a contoured wall that forms a plurality of lobes, typically in an even number. Each lobe has an inlet port and an outlet port defined by the contoured wall, and the rotor has a plurality of vanes that follow the contoured wall as the rotor spins. The rotor is driven by the charging fluid entering first and second lobes, located generally opposite one another, and exiting the lobes at a lower energy state. The driven rotor is operable to elevate the energy level of a feed fluid in third and fourth lobes, located generally opposite one another.

20 Claims, 6 Drawing Sheets

(51) Int. Cl.

| | |
|---|---|
| ***F03C 4/00*** | (2006.01) |
| ***F04C 2/00*** | (2006.01) |
| ***F01C 21/18*** | (2006.01) |
| ***F04C 15/06*** | (2006.01) |
| ***F04C 29/12*** | (2006.01) |
| ***F04C 2/344*** | (2006.01) |
| ***F01C 1/344*** | (2006.01) |
| ***F01C 21/10*** | (2006.01) |

(52) U.S. Cl.
CPC ..... *F01C 21/106* (2013.01); *F04C 2/3446* (2013.01); *F04C 15/06* (2013.01); *F04C 15/062* (2013.01); *F04C 29/122* (2013.01)

(58) Field of Classification Search
USPC ..... 418/1, 15, 209, 259, 260–268
See application file for complete search history.

(56) References Cited

U.S. PATENT DOCUMENTS

| | | | | |
|---|---|---|---|---|
| 3,905,204 | A | 9/1975 | Edwards | |
| 4,088,426 | A | 5/1978 | Edwards | |
| 4,183,352 | A * | 1/1980 | Spencer | F04C 15/06 418/15 |
| 4,355,965 | A | 10/1982 | Lowther | |
| 4,507,067 | A * | 3/1985 | Hansen | F04C 2/3442 418/262 |
| 5,819,554 | A | 10/1998 | Glen | |
| 6,589,033 | B1 | 7/2003 | Johnson et al. | |
| 7,140,853 | B2 | 11/2006 | Al Hawaj | |
| 2009/0087334 | A1 | 4/2009 | Whitesell | |
| 2010/0050628 | A1 | 3/2010 | Staffend et al. | |
| 2014/0048143 | A1 | 2/2014 | Lehner et al. | |
| 2014/0202144 | A1 | 7/2014 | Al-Hawaj | |

* cited by examiner

UNITARY PUMP AND TURBINE ENERGY EXCHANGER

CROSS-REFERENCED RELATED APPLICATIONS

The present invention claims the benefit of U.S. provisional application Ser. No. 61/981,880, filed Apr. 21, 2014, which is hereby incorporated by reference in its entirety.

FIELD OF THE INVENTION

The present invention relates to positive-displacement turbines and pumps and, more particularly, to turbines and pumps having a fluid-driven rotor mounted in a rotor casing or stator.

BACKGROUND OF THE INVENTION

Many industrial and consumer processes require an energy input, such as a fuel or other fluid (liquid or gas) at a relatively high energy state, and also produce a waste fluid (liquid or gas) at a lower energy state, but which still contains usable energy. There are known machines or processes for capturing some of the remaining energy in the waste fluid, and to use this energy to elevate the energy level of the input fluid in order to yield an overall increase in process efficiency. For example, a combustion engine may be fitted with a turbopump (also known as a turbocharger) that is driven by residual energy in exhaust gases, to increase the fluid pressure in the combustion chambers and yield a higher energy output of the engine than would otherwise be possible. In a similar fashion, energy recovery devices can be employed on reverse osmosis water purification systems, refrigeration processes, steam processes, and chemical refining processes.

Sliding-vane prime mover technology is generally known for use in positive-displacement devices that function by changing chamber volume. The change in chamber volume is accomplished by a sliding vane mounted to a rotor and following a cam-style surface of a rotor casing, which changes the chamber volume as the rotor spins and the sliding vane or vanes are driven along the cam-style surface. Such devices may be driven by an outside power source to produce a pumping or compressing effect, or the pressure or flow energy may be extracted to produce a turbine or expander effect. For example, such devices may be used in hydraulics, cryogenics, industrial fluid transfer, and the like.

SUMMARY OF THE INVENTION

The present invention provides an energy exchanging unitary pump and turbine device capable of transferring energy from one fluid to another fluid, where the fluids may be liquids, gases, or combinations thereof. The device utilizes a pump and turbine rotor mounted in a rotor casing having a contoured or cam-like wall that cooperates with the rotor to form a plurality of lobes. The arrangements of the lobes relative to one another, and the introduction and exhausting of a charging or working fluid and a separate feed fluid, are such that the rotor is substantially radially balanced (i.e., zero net radial force acting on the rotor during operation), and which has a relatively low parts-count and is readily accessible and serviceable without removing the rotor casing from the overall system in which it is used. The device may use sliding vanes along the rotor to operate as a positive displacement turbine/expander and pump/compressor, which are integrated into a single-rotor unitary pump and turbine.

According to one form of the present invention, a positive-displacement unitary pump and turbine includes a rotor casing or stator defining a rotor chamber, and a rotor positioned in the rotor chamber. The rotor chamber has a contoured or cam-like wall forming a plurality of lobes, which include at least first, second, third, and fourth lobes. The contoured wall has an inlet port and an outlet port defined at each of the lobes, for introducing and discharging fluids during operation of the unitary pump and turbine. The vanes are mounted at the rotor and are spaced circumferentially around an outer rotor surface, the vanes having respective distal ends or end portions that slidably engage the contoured wall of the rotor casing. The rotor is rotatably drivable by a charging fluid that is introduced into the first and second lobes at a higher energy state, via the respective inlet ports, and by discharging or exhausting the charging fluid at a lower energy state via respective outlet ports of the first and second lobes. The rotor is operable to elevate the energy state of a feed fluid from a lower energy state upon entering the third and fourth lobes via respective inlet ports, and subsequently exiting the third and fourth lobes at a higher energy state via respective outlet ports.

In one aspect, the lobes, the inlet and outlet ports, and the vanes are arranged so that during operation of the unitary pump and turbine, the higher energy charging fluid, the lower energy charging fluid, the lower energy feed fluid, and the higher energy feed fluid, act in combination on the rotor to apply a net radial force of substantially zero to the rotor, so that the rotor is substantially radially balanced during operation.

In other aspect, the first lobe is positioned directly across from the second lobe, and the third lobe is located or positioned substantially directly across from the fourth lobe.

In still another aspect, the unitary pump and turbine further includes first and second high energy charging fluid conduits, first and second low energy charging fluid conduits, first and second low energy feed fluid conduits, and first and second high energy feed fluid conduits. The first high energy charging fluid conduit has a downstream end in communication with the first lobe at its inlet port, and the second high energy charging fluid conduit has a downstream end in communication with the second lobe at its inlet port. The first low energy charging fluid conduit has an upstream end in communication with the first lobe at its outlet port, and the second low energy charging fluid conduit has an upstream end in communication with the second lobe at its outlet port. The first low energy feed fluid conduit has a downstream end in communication with the third lobe at its inlet port, and the second low energy feed fluid conduit has a downstream end in communication with the fourth lobe at the inlet port. The first high energy feed fluid conduit has an upstream end in communication with the third lobe at its outlet port, and the second high energy feed fluid conduit has an upstream end in communication with the fourth lobe at its outlet port.

Optionally, the rotor casing is unitarily formed with the high energy charging fluid conduit, the low energy charging fluid conduit, the low energy feed fluid conduit, and the high energy feed fluid conduit to form a one-piece pump and turbine body.

In a further aspect, the rotor chamber is configured to receive the charging fluid and the feed fluid in the form of respective compressible fluids or gases, so that each of the lobes forms a compression-expansion chamber.

According to another form of the present invention, a positive-displacement unitary pump and turbine energy exchanger includes a rotor casing defining a rotor chamber, a rotor positioned in the rotor chamber, a plurality of sliding vanes mounted at the rotor, a high energy charging fluid conduit, a low energy charging fluid conduit, a low energy feed fluid conduit, and a high energy feed fluid conduit. The contoured wall of the rotor casing forms at least four lobes of the rotor chamber, with a first lobe positioned substantially across from a second lobe, and a third lobe positioned substantially directly across from a fourth lobe. Each of the lobes has at least one inlet port and at least one outlet port defined in the contoured wall. The rotor has an outer rotor surface that is spaced inwardly from the contoured wall at the four lobes, and the sliding vanes are spaced circumferentially around the outer rotor surface, with proximal end portions received in the rotor and distal end portions configured to engage the contoured wall. The high energy charging fluid conduit has a first outlet in communication with the first lobe at its inlet port, and a second outlet in communication with the second lobe at its inlet port. The low energy charging fluid conduit has a first inlet in communication with the first lobe at its outlet port, and a second inlet in communication with the second lobe at its outlet port. The low energy feed fluid conduit has a first outlet in communication with the third lobe at its inlet port, and a second outlet in communication with the fourth lobe at its inlet port. The high energy feed fluid conduit has a first inlet in communication with the third lobe at its outlet port, and a second inlet in communication with the fourth lobe at its outlet port. The rotor is rotatably drivable by a charging fluid entering the first and second lobes at a higher energy state via the high energy charging fluid conduit, with the charging fluid exiting the first and second lobes at a low energy state via the low energy charging fluid conduit. The rotor is operable to convert a feed fluid entering the third and fourth lobes at a lower energy state via the low energy feed fluid conduit into a higher energy state upon exiting the third and fourth lobes via the high energy feed fluid conduit.

In one aspect, the rotor casing is unitarily formed with the high energy charging fluid conduit, the low energy charging fluid conduit, the low energy feed fluid conduit, and the high energy feed fluid conduit. Optionally, the rotor casing and the various fluid conduits identified above are unitarily formed from a cast metal alloy. For example, the high energy charging fluid conduit has separate conduit sections corresponding to respective ones of the first and second inlet ports of the first and second lobes, where the separate conduit sections of the high energy charging fluid conduit are in fluid communication with one another at an upstream end thereof. Similarly, the low energy charging fluid conduit includes separate conduit sections corresponding to the respective outlet ports of the first and second lobes, where the separate conduit sections are in fluid communication with one another at a downstream end. The low energy feed fluid conduit includes separate conduit sections in fluid communication with the inlet ports of the third and fourth lobes, with the separate conduit sections being in fluid communication with one another at an upstream end thereof. The high energy feed fluid conduit includes separate conduit sections in fluid communication with respective outlet ports of the third and fourth lobes, where the separate conduit sections are in fluid communication with one another at a downstream end thereof.

In another aspect, the various fluid conduits identified above are bifurcated into separate conduit sections for simultaneously feeding fluid to (or receiving fluid from) corresponding cross-chamber pairs of lobes.

In still another aspect, the contoured wall of the rotor casing forms exactly four chamber lobes, and there are exactly ten of the sliding vanes spaced evenly along the outer rotor surface for sliding engagement with the contoured wall.

In a further aspect, the rotor and the sliding vanes are configured so that the sliding vanes are independently movable inwardly and outwardly in a radial direction as the rotor is rotatably driven in the rotor chamber. Optionally, the sliding vanes are substantially rigid and are generally rectangular in shape.

In still another aspect, the unitary pump and turbine energy exchanger includes a fluid dynamic bearing and bearing housing, which are coupled to the rotor casing, and with the bearing housing at least partially covering or enclosing the rotor chamber. The bearing rotatably supports the rotor at the bearing housing. The rotor and vanes may be removable from the rotor chamber upon removal of the bearing housing from the rotor casing. Optionally, the bearing housing has an outer surface that forms an outermost surface of the unitary pump and turbine energy exchanger.

In another aspect, the at least four lobes of the chamber, the inlet and outlet ports, and the sliding vanes, are arranged so that each of (i) the higher energy charging fluid, (ii) the lower energy feed fluid, (iii) the lower energy charging fluid, and (iv) the higher energy feed fluid, acting in combination on the rotor, apply a net radial force of substantially zero to the rotor during its operation.

According to still another form of the present invention, a method is provided for operating a positive-displacement unitary pump and turbine. The method includes rotatably driving a pump or turbine rotor by introducing a charging fluid at a higher energy state into first and second lobes of a rotor chamber, where the first and second lobes are located opposite one another and are defined between a contoured wall of a rotor casing and the rotor, which has a plurality of vanes mounted at that or along an outer surface thereof, where the charging fluid is exhausted at a lower energy state out of the first and second lobes. The method further includes energizing a feed fluid with the pump or turbine rotor by introducing the feed fluid at a lower energy state into third and fourth lobes of the rotor chamber, the third and fourth lobes located opposite one another and defined between the contoured wall and the rotor, and then discharging the feed fluid at a higher energy state out of the third and fourth lobes.

Thus, the positive-displacement unitary pump and turbine of the present invention provides a single-rotor energy exchanger that is radially balanced and is operable to transfer energy from a charging fluid stream to a feed fluid stream, in order to elevate the energy state of the feed fluid stream, such as by increasing its pressure and/or temperature. The rotor may be fitted with a plurality of sliding vanes, and the rotor chamber is designed with an even number of lobes that may be circumferentially spaced so that the rotor is radially balanced during operation. The resulting unitary pump and turbine has a relatively small number of parts and is readily serviceable in the field simply by removing a cap or cover to access the rotor and vanes, and associated bearings or the like.

These and other objects, advantages, purposes and features of the present invention will become apparent upon review of the following specification in conjunction with the drawings.

DESCRIPTION OF THE PREFERRED EMBODIMENTS

Figure 1:
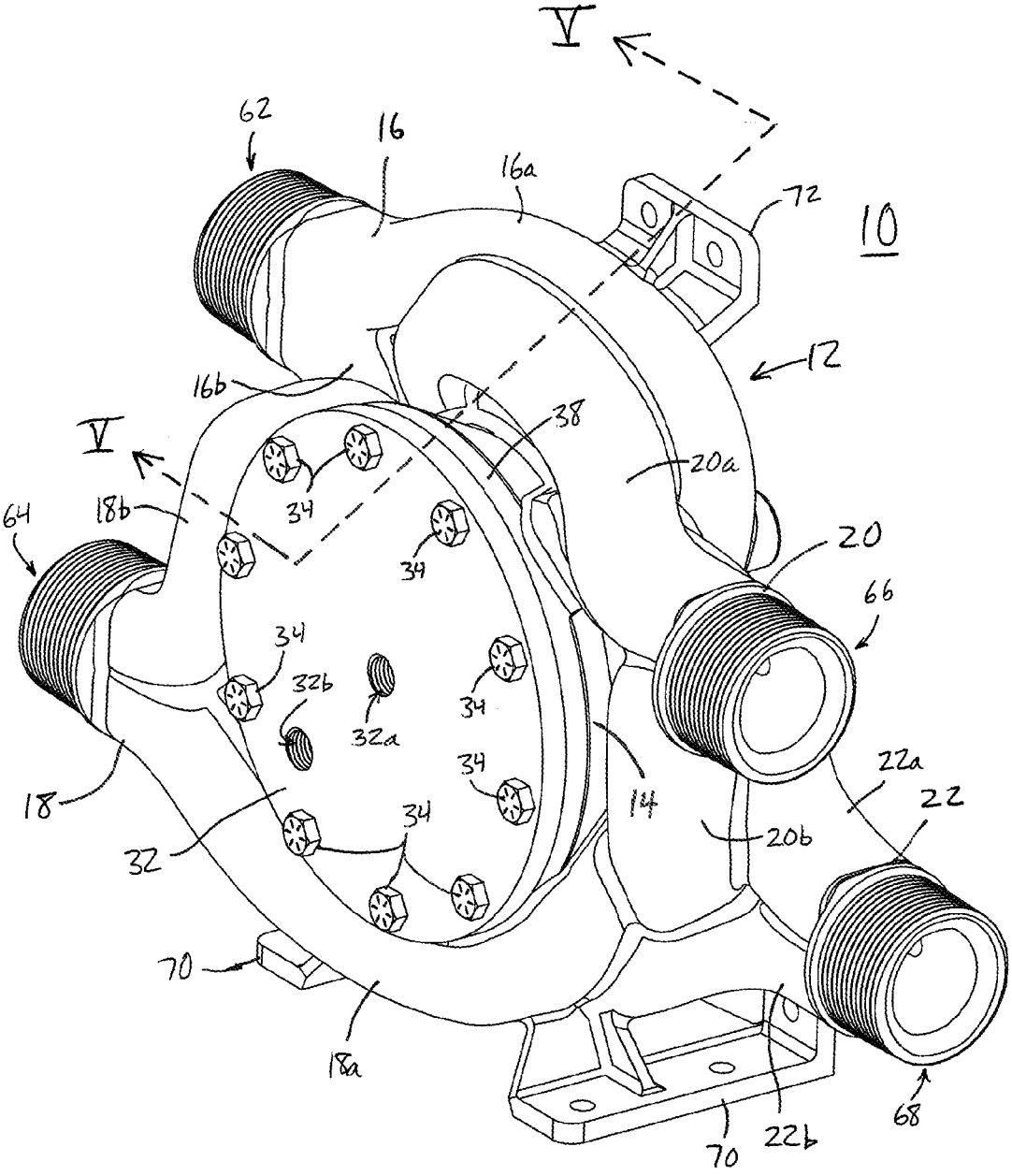
FIG. 1 is a perspective view of a unitary pump and turbine energy exchanger in accordance with the present invention.
Figure 2:
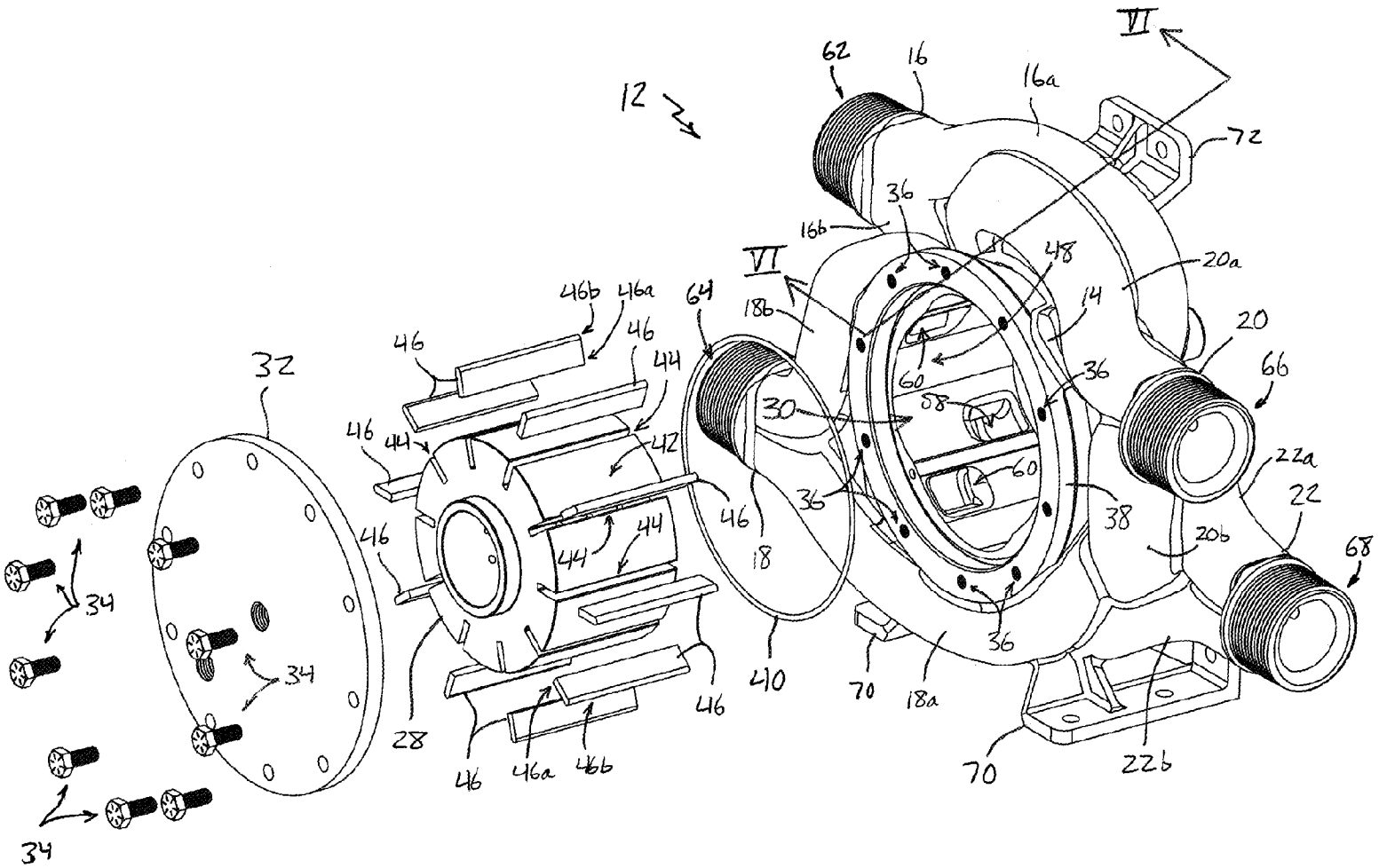
FIG. 2 is an exploded perspective view of the unitary pump and turbine energy exchanger of FIG. 1.
Figure 3:
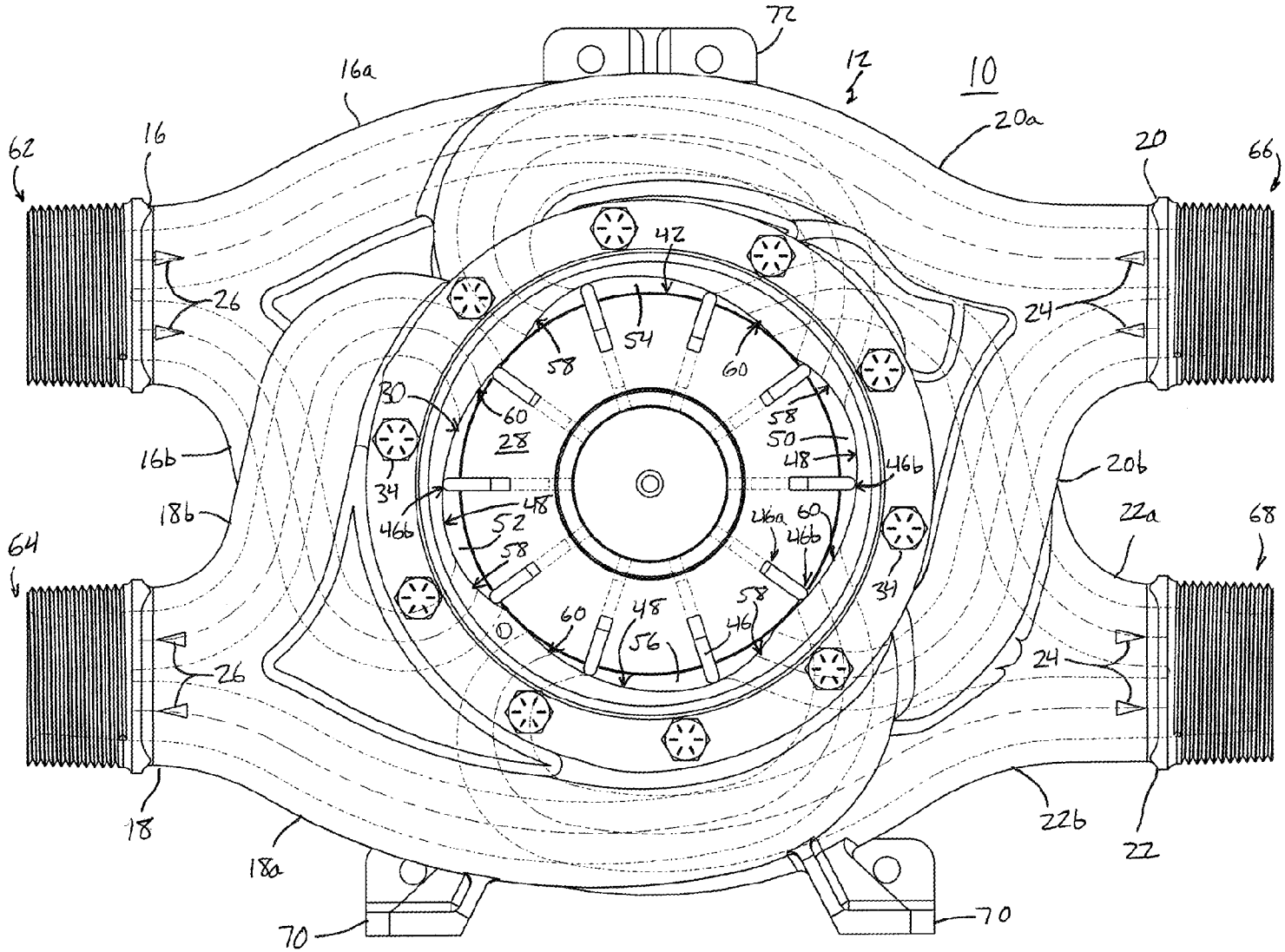
FIG. 3 is a front elevation of the unitary pump and turbine energy exchanger, with cap removed, and showing internal structure including fluid paths in phantom lines.

Referring now to the drawings and the illustrative embodiment depicted therein, a positive-displacement single-rotor unitary pump and turbine 10 is configured for use as a fluid energy exchanger. Unitary pump and turbine 10 includes a pump or turbine body 12 which, in the illustrated embodiment, is formed as a unitary casting including a rotor casing or stator 14, a bifurcated high energy charging fluid conduit 16, a bifurcated low energy charging fluid conduit 18, a bifurcated low energy feed fluid conduit 20, and a bifurcated high energy feed fluid conduit 22 (FIGS. 1-3). As will be described in more detail below, each fluid conduit is in fluid communication with a respective chamber lobe formed in rotor casing 14, so that unitary pump and turbine 10 is operable to elevate an energy state of a feed fluid 24 using energy from a charging fluid 26, such as shown diagrammatically in FIG. 4.

Figure 5:
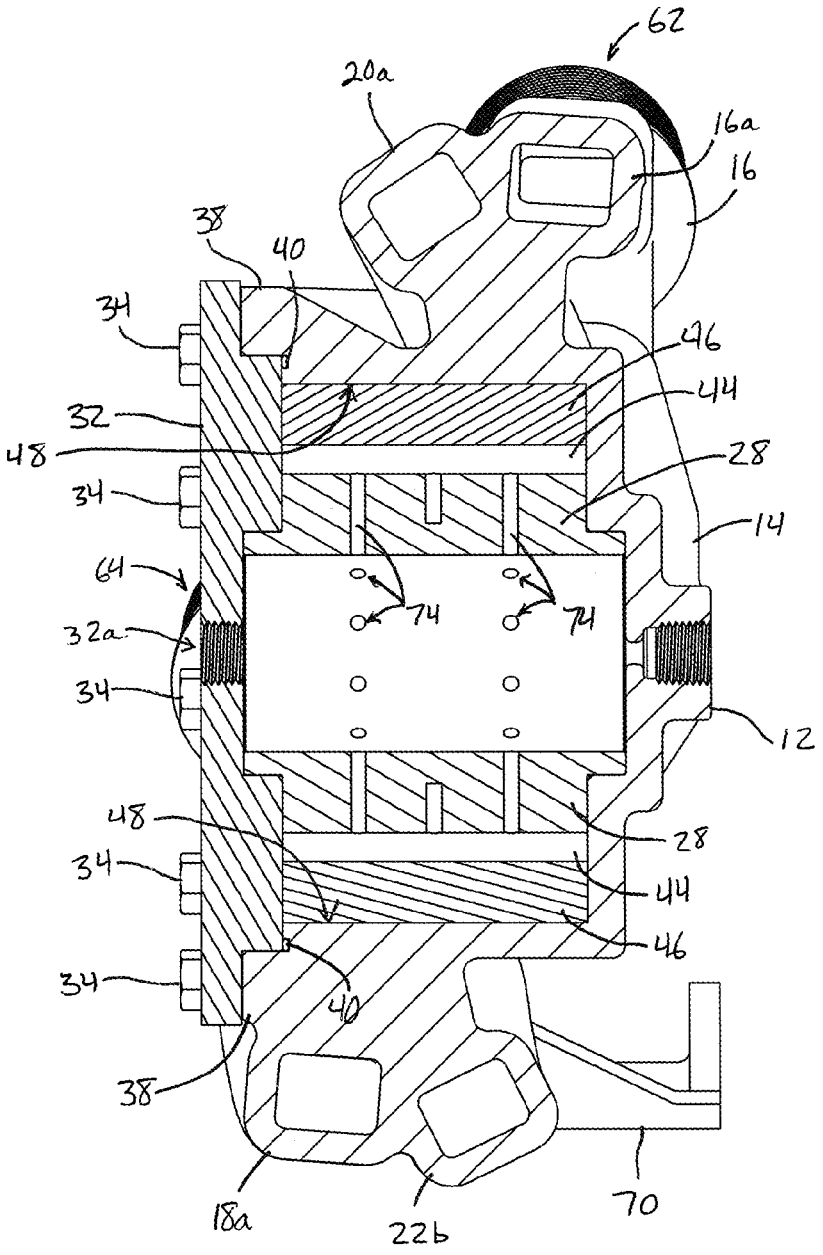
FIG. 5 is a side sectional elevation of the unitary pump and turbine energy exchanger, taken along section line V-V in FIG. 1.
Figure 6:
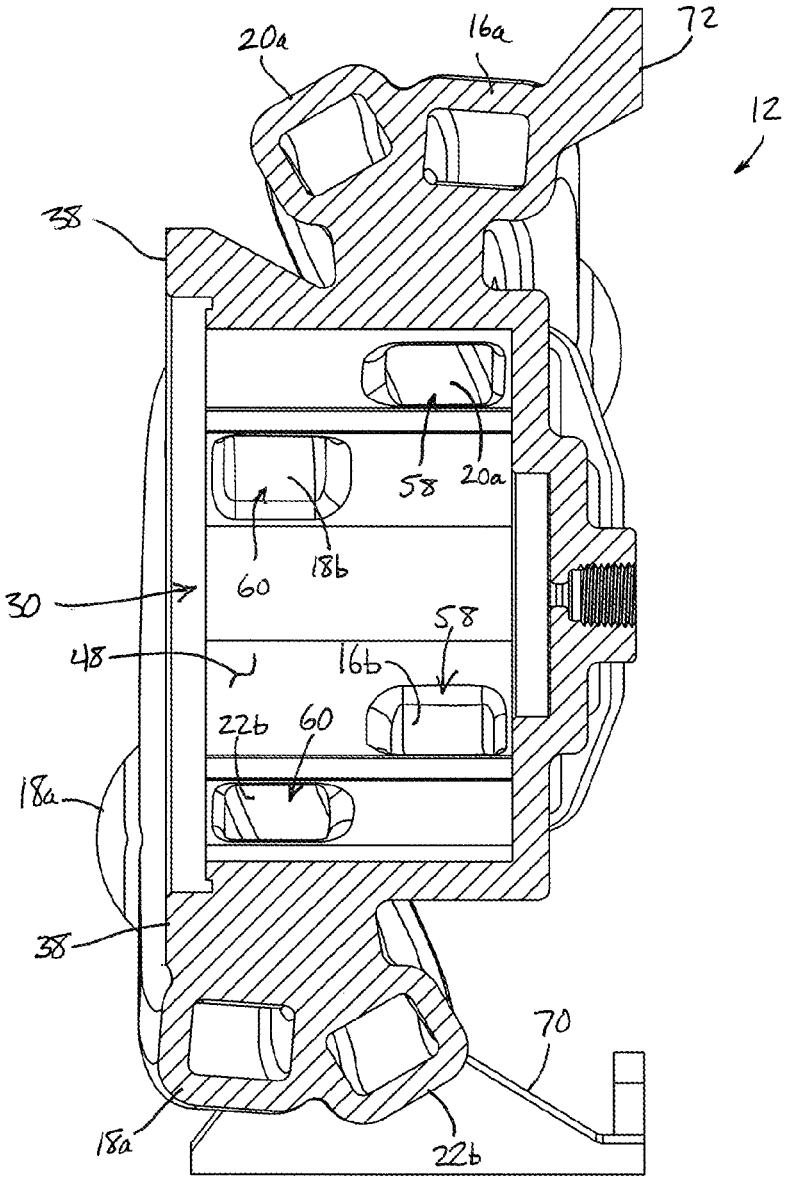
FIG. 6 is a side sectional elevation of the unitarily-formed rotor casing and fluid conduits of the unitary pump and turbine energy exchanger, taken along section line VI-VI in FIG. 2.

Turbine 10 includes a generally cylindrical rotor 28 that fits into a rotor chamber 30 defined in rotor casing 14, such as shown in FIG. 2. A bearing cover or cap 32 encloses rotor chamber 30, and is held in place with a plurality of threaded fasteners 34 that are received in respective threaded bores 36 formed in an outer rim 38 of rotor casing 14. An O-ring gasket 40 is seated between bearing cover 32 and outer rim 38 (FIGS. 2 and 5) to seal off rotor chamber 30 from the outside environment. Optionally, bearing cover 32 includes a central bore 32*a* and an outboard bore 32*b*, which may be used to introduce lubrication or cleaning fluids, or pressurized gas or fluid, into rotor 28 and rotor chamber 30, for example. Rotor 28 has a generally cylindrical outer surface 42 in which is formed a plurality of radially-aligned slots for receiving respective sliding vanes 46 that engage a cam-like contoured wall 48 that defines an outer periphery of rotor chamber 30.

Figure 4:
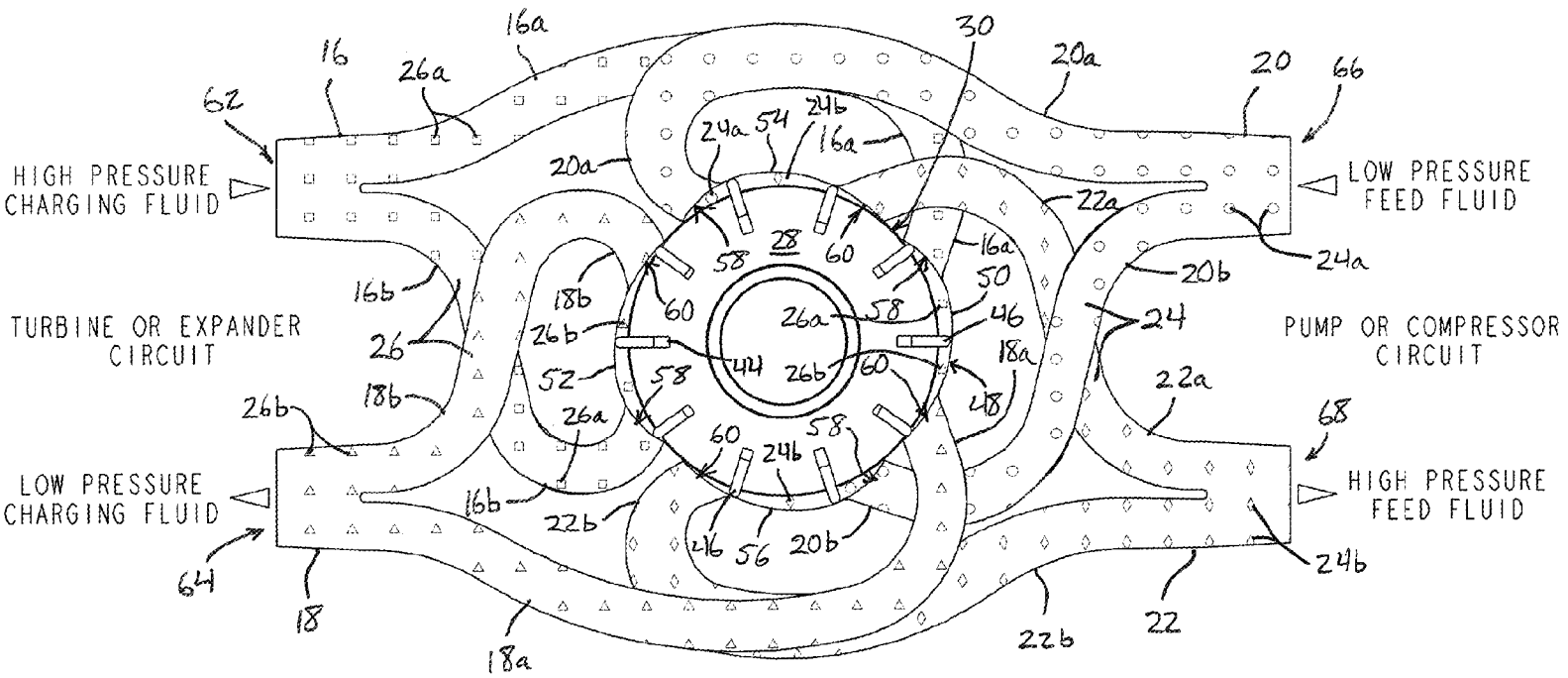
FIG. 4 is a front elevation depicting the fluid paths through the unitary pump and turbine energy exchanger.

As best shown in FIGS. 3 and 4, rotor chamber 30 has four lobes including a first lobe 50 located generally at the three o'clock position as viewed in FIGS. 3 and 4, a second lobe 52 located at the nine o'clock position across from first lobe 50, a third lobe 54 located generally at the twelve o'clock position, and a fourth lobe 56 located generally at the six o'clock position opposite third lobe 54. Each lobe includes a respective fluid inlet 58 and fluid outlet 60 defined in contoured wall 48, with each fluid inlet 58 and each fluid outlet 60 being in fluid communication with a respective one of the fluid conduits 16, 18, 20, 22, as will be described below.

In the illustrated embodiment, each fluid conduit 16, 18, 20, 22 is bifurcated into two separate conduit portions (designated with 'a' and 'b' suffixes) that come together and are in fluid communication with one another at locations spaced distally from rotor casing 14. High energy charging fluid conduit 16 includes a first conduit portion 16*a* in fluid communication at its downstream end with first lobe 50 at its inlet 58, and a second high energy charge fluid conduit portion 16*b* having a downstream end that is in fluid communication with second lobe 52 at its inlet 58. Bifurcated low energy charging fluid conduit 18 includes a first conduit portion 18*a* having an upstream end in fluid communication with first lobe 50 at its fluid outlet 60, and a second conduit portion 18*b* having an upstream end in fluid communication with second lobe 52 at its fluid outlet 60. Low energy feed fluid conduit 20 includes a first conduit portion 20*a* having a downstream end in fluid communication with third lobe 54 at its fluid inlet 58, and a second conduit portion 20*b* having a downstream end in fluid communication with fourth lobe 56 at its fluid inlet 58. Bifurcated high energy feed fluid conduit 22 includes a first conduit portion 22*a* having an upstream end in fluid communication with third lobe 54 at its fluid outlet 60, and a second portion 22*b* having an upstream end in fluid communication with fourth lobe 56 at its fluid outlet 60.

The first and second conduit portions 16*a*, 16*b* of high energy charging fluid conduit 16 join and are in fluid communication with one another at a high pressure charging fluid fitting or inlet 62. The first and second conduit portions 18*a*, 18*b* of low energy charging fluid conduit 18 join and are in fluid communication with one another at a low pressure charging fluid outlet or fitting 64. The first and second conduit portions 20*a*, 20*b* of low energy feed fluid conduit 20 join and are in fluid communication with one another at a low energy feed fluid inlet or fitting 66. The first and second conduit portions 22*a*, 22*b* of high energy feed fluid conduit 22 join and are in fluid communication with one another at a high energy feed fluid outlet for fitting 68.

This arrangement of fluid conduits permits feed fluid 24 and charging fluid 26 to be directed into their respective portions (lobes) of rotor chamber 30 at opposite sides thereof, so that the radial pressure applied to rotor 28 is balanced by substantially equal fluid pressures in first lobe 50 and second lobe 52, and by substantially equal fluid pressures in third lobe 54 and fourth lobe 56. This results in a balancing of forces because first lobe 50 is located directly across from second lobe 52, and third lobe 54 is located directly across from fourth lobe 56. In addition, the locations of fluid inlets 58 and outlets 60, as well as the number (ten are shown) and spacing of sliding vanes 46, may be selected so that respective vanes 46 that are directly opposite from one another are positioned at corresponding locations in their respective lobes as rotor 28 turns (FIGS. 3 and 4), so that the volumes of high and low pressure charging fluid 26 in first lobe 50 are equal to the volumes of high and low pressure charging fluid 26 in second lobe 52, and so that the volumes of high and low pressure feed fluid 24 in third chamber 54 is equal to the volumes of high and low energy feed fluid 24 in fourth lobe 56. Thus, during normal operation of rotor 28, the rotor experiences little or mechanically negligible net radial force, which reduces wear and facilitates the efficient and low-maintenance operation of the pump or turbine. The use of single inlets 62, 64, 66, 68 for bifurcated fluid conduits also permits single couplings for separate conduit portions, while ensuring that the fluid pressure in each conduit portion is equal to that in the corresponding conduit portion, thus also ensuring substantially equal fluid pressures in the respective lobes 50, 52, and 54, 56 that are located directly across from one another.

Turbine body 12, including rotor casing 14 and fluid conduits 16, 18, 20, 22 and fluid fittings 62, 64, 66, 68, may be unitarily formed as a one-piece unit, such as via a casting process utilizing ferrous or non-ferrous alloy, such as steel or aluminum alloys. However, it is further envisioned that non-metals may be used, such as thermoplastics, fiber-reinforced thermoplastics, thermoset plastics, and fiber-reinforced thermoset plastics. It is further envisioned that the fluid conduits and rotor casing may be made from plastics or relatively weaker materials, with a hardened insert (such as a metal liner) used to form contoured wall 48, which may be integrated with outer rim 38 to form wear-resistant and strong bores 36.

Optionally, and as shown, pump or turbine body 12 includes a pair of base brackets 70 and an upper bracket 72, such as shown in FIGS. 1-3, to facilitate mounting unitary pump and turbine 10 in a desired location within a system. Finishing steps on pump or turbine body 12 may be completed by machining male threads at each fluid fitting 62, 64, 66, 68, by machining outer rim 38 and bores 36, and by machining contoured wall 48 of rotor chamber 30 to achieve desired tolerances and surface finishes. Optionally, finishing steps on unitary pump and turbine body 12 may be completed by machining the various fluid fittings with other common fluid piping connections, such as grooved style fittings, pipe flanges, or the like.

As noted above, rotor 28 includes sliding vanes 46 that engage and slide along contoured wall 48 of rotor chamber 30 as the rotor spins within the rotor chamber. Sliding vanes 46 each include a proximal edge portion 46*a* that is received in a respective slot 44 along an outer surface 42 of the rotor 28, and a distal edge portion 46*b* that slides along contoured wall 48. In the illustrated embodiment, vanes 46 are generally rectangular in shape and are made of a substantially rigid material, such as metal or reinforced plastic. However, it is envisioned that flexible vanes may be suitable for some applications, including flexible vanes that could be integrally formed with a rotor body, without departing from the spirit and scope of the present invention. Vanes 46 are substantially free to slide radially inwardly and outwardly as they follow the contoured wall 48, including the lobes 50, 52, 54, 56.

Although it is envisioned that rotor 28 may spin at sufficient speed so that centrifugal force urges vanes 46 radially outwardly into contact with contour wall 48, it is further envisioned that, optionally, biasing members such as resilient springs or the like may be inserted into radially-aligned bores 74 (FIG. 5) that are open to slots 44 and used to bias the vanes 46 radially outwardly to help ensure contact with contoured wall 48 even at low rotational speeds of rotor 28. Optionally, a pressurized gas or liquid (e.g., hydraulic fluid) could be introduced into a hollow central region of rotor 28, such as via central bore 32*a* of bearing cover 32 (FIG. 5), to pressurize slots 44 via bores 74 and thus urge vanes 46 radially outwardly, assuming sufficiently tight tolerances of vanes 46 in slots 44.

To operate unitary pump and turbine 10, high pressure charging fluid inlet or fitting 62 is coupled to a high energy charging fluid source, low energy charging fluid fitting or outlet 64 is coupled to a conduit or other component for receiving low energy charging fluid 26, low energy feed fluid inlet or fitting 66 is coupled to a source of low energy feed fluid 24, and high energy feed fluid outlet or fitting 68 is coupled to a conduit or other device configured to receive the high energy feed fluid 22. Referring to FIGS. 3 and 4, high energy charging fluid 26*a* is introduced into the high energy charging fluid conduit 16, whereupon it divides or bifurcates into first portion 16*a* and second portion 16*b* for routing to the respective fluid inlet 58 at first lobe 50 and second lobe 52. High energy charging fluid 26*a* acts upon the vane or vanes 46 that are exposed to high energy charging fluid 26*a*, which begins to drive rotor 28 in a clockwise direction as viewed in FIGS. 3 and 4. As rotor 28 continues to rotate, the high energy charging fluid 26*a* loses some of its energy (e.g. fluid pressure) to the driving of rotor 28, and is subsequently vented or discharged as low energy charging fluid 26*b* out of first lobe 50 and second lobe 52 through the respective fluid outlets 60, once the fluid outlets are exposed to low energy charging fluid 26*b* by the position of vanes 46. Two streams of low energy charging fluid 26*b* flow away from rotor chamber 30 via respective low energy charging fluid conduit portions 18*a*, 18*b* until rejoining at low energy charging fluid fitting 64. As noted above, because first lobe 50 is located directly across from second lobe 52, the radial forces applied to rotor 28 by charging fluid 26 are balanced across the rotor.

As rotor 28 is being rotationally driven by the charging fluid 26, low energy feed fluid 24*a* is introduced through low energy feed fluid inlet 66 whereupon it is bifurcated and directed to the respective fluid inlets 58 of third lobe 54 and fourth lobe 56 via first conduit portion 20*a* and second conduit portion 20*b* until a charge of low energy feed fluid 24*a* is closed off in each lobe by adjacent vanes 46, after which further rotation of rotor 28 causes the feed fluid 24 to be compressed and/or pressurized as it approaches and eventually exits the respective fluid outlets 60 of third lobe 54 and fourth lobe 56, whereupon the feed fluid 24 is at a higher energy state 24*b* and travels through first conduit portion 22*a* and second conduit portion 22*b* to eventually rejoin at high energy feed fluid outlet for fitting 68. As noted above, because third lobe 54 is located directly across from fourth lobe 56, the radial forces applied by the feed fluid 24 to rotor 28 are balanced across the rotor.

Accordingly, unitary pump and turbine 10 operates continuously to exchange energy from charging fluid 26 to feed fluid 24 utilizing a single rotor 28 turning in a single rotor chamber 30 having at least four lobes, with two lobes 50, 52 dedicated to charging fluid 26, and two lobes 54, 56 dedicated to feed fluid 24. Rotor 28 is radially balanced during operation, and is readily accessible for service or maintenance via a single cover that may also support a fluid dynamic rotor bearing or the like. Unitary pump and turbine 10 is readily serviceable in a system in which it is mounted, often without need for removing the casing from the system, and even without disconnecting the casing from the various fluid sources or conduits to which it is coupled. While unitary pump and turbine 10 can be made highly efficient with minimal energy loss, it will be appreciated that the energy drop between low energy charging fluid 26*b* and high energy charging fluid 26*a* will necessarily be greater than the energy gain between low energy feed fluid 24*a* and high energy feed fluid 24*b*, due to frictional losses, flow energy losses in the conduits, and the like.

Although the unitary pump and turbine energy exchanger of the illustrated embodiment has exactly four lobes 50, 52, 54, 56 and exactly ten vanes 46 that are evenly spaced circumferentially around rotor 28, it will be appreciated that a unitary pump and turbine energy exchanger may be configured with different numbers of lobes and different number of vanes, without departing from the spirit and scope of the present invention. For example, substantially any even number of lobes, four or greater, may achieve substantially the same balanced-force effect as the four-lobe embodiment that is primarily described herein. In the case of a six-lobe variant, for example, three lobes would be spaced at 120-degree intervals for receiving and discharging the charging fluid, while three other lobes would be interspersed at 120-degree intervals (i.e., one lobe every 60-degrees) for handling the feed fluid, while still permitting balanced radial forces along the rotor. It is further envisioned that the charging fluid conduits and feed fluid conduits could be eliminated or substantially shortened, such as to reduce complexity and cost of casting molds, so that the fluids would be introduced and discharged from the rotor chamber via separate conduits that are coupled directly to the rotor casing, or to respective short conduits associated with the casing.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A positive-displacement unitary pump and turbine comprising:

a rotor casing defining a rotor chamber having a contoured wall forming a plurality of lobes of said chamber, said lobes comprising at least a first lobe, a second lobe, a third lobe and a fourth lobe;

an inlet port and an outlet port defined in said contoured wall at each of said lobes;

a rotor positioned in said rotor chamber, said rotor having an outer rotor surface spaced inwardly from said contoured wall at said at least four lobes; and a plurality of vanes mounted at said rotor and spaced circumferentially around said outer rotor surface, said vanes having distal end portions configured to slidably engage said contoured wall;

wherein said rotor is rotatably drivable by a charging fluid at a higher energy state entering said first and second lobes at respective ones of said inlet ports and the charging fluid exiting said first and second lobes at a lower energy state via respective ones of said outlet ports; and wherein said rotor is operable to convert a feed fluid at a lower energy state entering said third and fourth lobes via respective ones of said inlet ports into a higher energy state upon exiting said third and fourth lobes via respective ones of said outlet ports.

2. The positive-displacement unitary pump and turbine of claim 1, wherein said lobes, said inlet and outlet ports, and said vanes are arranged so that each of (i) the higher energy charging fluid, (ii) the lower energy feed fluid, (iii) the lower energy charging fluid, and (iv) the higher energy feed fluid, acting in combination, apply a zero net radial force to said rotor during operation.

3. The positive-displacement unitary pump and turbine of claim 2, wherein said first lobe is located across from said second lobe, and said third lobe is located across from said fourth lobe.

4. The positive-displacement unitary pump and turbine of claim 1, further comprising:

a first high energy charging fluid conduit having a downstream end in communication with said inlet port of said first lobe, and a second high energy charging fluid conduit having a downstream end in communication with said inlet port of said second lobe;

a first low energy charging fluid conduit having an upstream end in communication with said outlet port of said first lobe, and a second low energy charging fluid conduit having an upstream end in communication with said outlet port of said second lobe;

a first low energy feed fluid conduit having a downstream end in communication with said inlet port of said third lobe, and a second low energy feed fluid conduit having a downstream end in communication with said inlet port of said fourth lobe; and a first high energy feed fluid conduit having an upstream end in communication with said outlet port of said third lobe, and a second high energy feed fluid conduit having an upstream end in communication with said outlet port of said fourth lobe.

5. The positive-displacement unitary pump and turbine of claim 4, wherein said rotor casing is unitarily formed with said first and second high energy charging fluid conduits, said first and second low energy charging fluid conduits, said first and second low energy feed fluid conduits, and said first and second high energy feed fluid conduits.

6. The positive-displacement unitary pump and turbine of claim 1, wherein said rotor chamber is configured to receive the charging fluid and the feed fluid in the form of respective compressible fluids, and wherein each of said lobes comprises a compression-expansion chamber.

7. A positive-displacement unitary pump and turbine energy exchanger comprising:

a rotor casing defining a rotor chamber having a contoured wall forming at least four lobes of said chamber, wherein a first of said lobes is located across from a second of said lobes and a third of said lobes is located across from a fourth of said lobes;

an inlet port and an outlet port defined in said contoured wall at each of said lobes;

a rotor positioned in said rotor chamber, said rotor having an outer rotor surface spaced inwardly from said contoured wall at said at least four lobes;

a plurality of sliding vanes mounted at said rotor and spaced circumferentially around said outer rotor surface, said sliding vanes having proximal end portions received in said rotor and distal end portions configured to engage said contoured wall;

a high energy charging fluid conduit having a first conduit portion in communication with said inlet port of said first lobe and a second conduit portion in communication with said inlet port of said second lobe;

a low energy charging fluid conduit having a first conduit portion in communication with said outlet port of said first lobe and a second conduit portion in communication with said outlet port of said second lobe;

a low energy feed fluid conduit having a first conduit portion in communication with said inlet port of said third lobe and a second conduit portion in communication with said inlet port of said fourth lobe; and a high energy feed fluid conduit having a first conduit portion in communication with said outlet port of said third lobe and a second conduit portion in communication with said outlet port of said fourth lobe;

wherein said rotor is rotatably drivable by a charging fluid entering said first and second lobes at a higher energy state via said high energy charging fluid conduit and the charging fluid exiting said first and second lobes at a lower energy state via said low energy charging fluid conduit; and wherein said rotor is operable to convert a feed fluid entering said third and fourth lobes at a lower energy state via said low energy feed fluid conduit into a higher energy state upon exiting said third and fourth lobes via said high energy feed fluid conduit.

8. The unitary pump and turbine energy exchanger of claim 7, wherein said rotor casing is unitarily formed with said high energy charging fluid conduit, said low energy charging fluid conduit, said low energy feed fluid conduit, and said high energy feed fluid conduit.

9. The unitary pump and turbine energy exchanger of claim 8, wherein said rotor casing, said high energy charging fluid conduit, said low energy charging fluid conduit, said low energy feed fluid conduit, and said high energy feed fluid conduit are unitarily formed of cast or injection molded material.

10. The unitary pump and turbine energy exchanger of claim 7, wherein:

said high energy charging fluid conduit comprises a bifurcated conduit in which said first and second conduit portions of said high energy charging fluid conduit are in fluid communication with one another at an upstream end of said high energy charging fluid conduit;

said low energy charging fluid conduit comprises a bifurcated conduit in which said first and second conduit portions of said low energy charging fluid conduit are in fluid communication with one another at a downstream end of said low energy charging fluid conduit;

said low energy feed fluid conduit comprises a bifurcated conduit in which said first and second conduit portions of said low energy feed fluid conduit are in fluid communication with one another at an upstream end of said low energy feed fluid conduit; and said high energy feed fluid conduit comprises a bifurcated conduit in which said first and second conduit portions of said high energy feed fluid conduit are in fluid communication with one another at a downstream end of said high energy feed fluid conduit.

11. The unitary pump and turbine energy exchanger of claim 7, wherein said contoured wall forms exactly four lobes of said chamber, and wherein exactly ten of said sliding vanes are spaced evenly along said outer rotor surface.

12. The unitary pump and turbine energy exchanger of claim 7, wherein said rotor and said sliding vanes are configured so that said sliding vanes are independently moveable inwardly and outwardly in a radial direction as said rotor is rotatably driven in said rotor chamber.

13. The unitary pump and turbine energy exchanger of claim 12, wherein said sliding vanes are rigid and have a generally rectangular shape.

14. The unitary pump and turbine energy exchanger of claim 7, further comprising a bearing housing and bearing coupled to said rotor casing, said bearing housing at least partially covering said rotor chamber, and wherein said bearing rotatably supports said rotor at said bearing housing.

15. The unitary pump and turbine energy exchanger of claim 14, wherein said rotor and said vanes are removable from said rotor chamber upon removal of said bearing housing from said rotor casing.

16. The unitary pump and turbine energy exchanger of claim 15, wherein said bearing housing comprises an outer surface that forms an outermost surface of said unitary pump and turbine energy exchanger.

17. The unitary pump and turbine energy exchanger of claim 7, wherein said at least four lobes of said chamber, said inlet and outlet ports, and said sliding vanes are arranged so that each of (i) the higher energy charging fluid, (ii) the lower energy feed fluid, (iii) the lower energy charging fluid, and (iv) the higher energy feed fluid, acting in combination, apply a zero net radial force to said rotor during operation.

18. A method of operating a positive-displacement unitary pump and turbine, said method comprising:

rotatably driving a pump or turbine rotor by:

introducing a charging fluid at a higher energy state into first and second lobes of a rotor chamber, the first and second lobes located opposite one another and defined between a contoured wall of a rotor casing and the rotor, and the rotor having a plurality of vanes mounted at an outer surface of the rotor; and discharging the charging fluid at a lower energy state out of the first and second lobes; and energizing a feed fluid with the rotor by:

introducing the feed fluid at a lower energy state into third and fourth lobes of the rotor chamber, the third and fourth lobes located opposite one another and defined between the contoured wall and the rotor; and discharging the feed fluid at a higher energy state out of the third and fourth lobes.

19. The method of claim 18, wherein the vanes comprise sliding vanes mounted in respective slots aligned radially along an outer surface of the rotor.

20. The method of claim 18, comprising applying a zero net radial force to the rotor via said introducing and discharging the charging fluid, and said introducing and discharging the feed fluid.

* * * * *